US008104100B2

(12) United States Patent
Razzaghi et al.

(10) Patent No.: US 8,104,100 B2
(45) Date of Patent: Jan. 31, 2012

(54) SUSPENDERS

(75) Inventors: Ali Razzaghi, New York, NY (US); Eric Fehlberg, Queens, NY (US); Caleb Crye, Brooklyn, NY (US); Gregg Thompson, Brooklyn, NY (US)

(73) Assignee: Lion Apparel, Inc., Dayton, OH (US)

( * ) Notice: Subject to any disclaimer, the term of this patent is extended or adjusted under 35 U.S.C. 154(b) by 1354 days.

(21) Appl. No.: 11/333,851

(22) Filed: Jan. 18, 2006

(65) Prior Publication Data

US 2006/0230504 A1 Oct. 19, 2006

Related U.S. Application Data

(60) Provisional application No. 60/671,424, filed on Apr. 14, 2005.

(51) Int. Cl.
*A41F 19/00* (2006.01)

(52) U.S. Cl. ..... 2/327

(58) Field of Classification Search ..... 2/79, 227, 2/329, 326, 327, 328, 336, 310, 340
See application file for complete search history.

(56) References Cited

U.S. PATENT DOCUMENTS

| | | | | |
|---|---|---|---|---|
| 3,484,870 | A | 12/1969 | Tempelhof | |
| 4,473,614 | A | 9/1984 | Hockmeyer | |
| 4,481,682 | A | 11/1984 | Hall | |
| 4,888,830 | A * | 12/1989 | Putnam | 2/327 |
| 4,922,552 | A | 5/1990 | Grilliot et al. | |
| 4,967,421 | A | 11/1990 | Grilliot et al. | |
| RE34,094 | E * | 10/1992 | Grilliot et al. | 2/327 |
| 5,165,110 | A | 11/1992 | Grilliot et al. | |
| 5,168,582 | A | 12/1992 | Aldridge | |
| 5,319,806 | A | 6/1994 | Hermann et al. | |
| 5,515,543 | A | 5/1996 | Gioello | |
| 5,548,843 | A | 8/1996 | Chase et al. | |
| 5,611,079 | A | 3/1997 | Bain, III | |
| 5,617,581 | A | 4/1997 | Robbins | |
| 5,628,063 | A | 5/1997 | Reed | |
| 5,691,028 | A | 11/1997 | Curtis | |
| 5,729,832 | A | 3/1998 | Grilliot et al. | |
| 5,791,538 | A | 8/1998 | Bain, III | |
| 5,806,095 | A * | 9/1998 | Cotten | 2/79 |

(Continued)

FOREIGN PATENT DOCUMENTS

CA 1183653 3/1985

(Continued)

OTHER PUBLICATIONS

EP, Partial European Search Report, European Application No. 09157122.4 (Sep. 15, 2010).

(Continued)

*Primary Examiner* — Tejash Patel
(74) *Attorney, Agent, or Firm* — Thompson Hine LLP

(57) ABSTRACT

A suspenders assembly including a pair of suspenders having a pair of front strap portions configured to be coupled to a front portion of a pair of trousers and a pair of rear strap portions configured to be coupled to a rear portion of the pair of trousers. The assembly further includes an attachment tab, wherein both of the rear strap portions or both of the front strap portions are both directly and permanently coupled to the attachment tab. The attachment tab includes a portion of hook-and-loop fastening material located thereon.

39 Claims, 6 Drawing Sheets

U.S. PATENT DOCUMENTS

| | | | | |
|---|---|---|---|---|
| 5,896,583 | A | 4/1999 | Grilliot et al. | |
| 6,026,516 | A | 2/2000 | Dacyshyn | |
| 6,125,475 | A | 10/2000 | Taylor | |
| 6,167,573 | B1 | 1/2001 | Lewis | |
| 6,202,214 | B1 | 3/2001 | Light | |
| 6,308,338 | B1 * | 10/2001 | Caldwell | 2/312 |
| 6,317,889 | B1 | 11/2001 | Reilly et al. | |
| 6,401,245 | B1 | 6/2002 | Slautterback | |
| 6,427,252 | B1 | 8/2002 | Lewis et al. | |
| 6,662,372 | B2 | 12/2003 | Lewis et al. | |
| 6,678,895 | B1 | 1/2004 | Grilliot et al. | |
| 6,687,919 | B2 | 2/2004 | Dilworth, Jr. et al. | |
| 6,698,031 | B2 | 3/2004 | Lewis | |
| 6,766,532 | B1 | 7/2004 | Cabana | |
| 6,836,904 | B2 | 1/2005 | Harper | |
| 7,086,091 | B2 * | 8/2006 | Jordan | 2/69 |
| 2003/0213046 | A1 | 11/2003 | Lewis | |

FOREIGN PATENT DOCUMENTS

| | | |
|---|---|---|
| CA | 2230352 | 8/1999 |
| DE | 3902933 | 8/1990 |
| JP | 10-038895 | 2/1998 |
| JP | 10327727 | 12/1998 |
| JP | 11-235391 | 8/1999 |
| JP | 2003227012 | 8/2003 |

OTHER PUBLICATIONS

EP, Extended European Search Report, European Application No. 09157122.4 (Apr. 20, 2011).

EP, Examination Report, European Application No. 09157122.4 (Sep. 8, 2011).

* cited by examiner

SUSPENDERS

This application claims priority to U.S. Provisional Application Ser. No. 60/671,424, filed Apr. 14, 2005, the entire contents of which are hereby incorporated by reference.

This application is directed to suspenders, and more particularly, to suspenders for use with protective garments.

BACKGROUND

Protective or hazardous duty trousers are used in a variety of industries and settings to protect the wearer from hazardous conditions such as heat, smoke, cold, sharp objects, chemicals, liquids, fumes and the like. Such trousers should properly fit and conform to the wearer's body to ensure proper protection. For example, protective trousers should be long enough to ensure complete coverage and protection, but should not be so long as to present a tripping hazard. Furthermore, the trousers should not impede the climbing and walking of the wearer, and should be retained in the proper position.

In order to ensure a proper fit and positioning, suspenders may be used with the protective trousers. The suspenders may include straps that attach to the protective trousers and extend over a wearer's shoulders. The suspenders may provide additional support to the trousers while allowing a user to adjust the height of the trousers relative to the wearer's body. Furthermore, suspenders may allow a wearer to quickly put on and take off the protective trousers.

Many existing suspenders may present various problems and disadvantages. For example, existing suspenders may be difficult and time consuming to attach to, and detach from, the trousers. Furthermore, firefighters and other emergency personnel may use the protective trousers in combination with a tank, such as a self contained breathing apparatus ("SCBA") tank worn on the wearer's back. However, existing protective trousers and suspenders may not provide cushioning and protection from such tanks.

Accordingly, there is a need for suspenders that may be quickly and easily attached to and detached from a protective garment. There is also a need for suspenders that provide protection to a wearer's back.

SUMMARY

In one embodiment, the present invention is a pair of suspenders that can be quickly and easily attached to and detached from a protective garment. In particular, in one embodiment the invention is a suspenders assembly including a pair of suspenders having a pair of front strap portions configured to be coupled to a front portion of a pair of trousers and a pair of rear strap portions configured to be coupled to a rear portion of the pair of trousers. The assembly further includes an attachment tab, wherein both of the rear strap portions or both of the front strap portions are both directly and permanently coupled to the attachment tab. The attachment tab includes a portion of hook-and-loop fastening material located thereon.

In another embodiment the invention is a suspenders assembly including a pair of suspenders including a pair of front strap portions and a pair of rear strap portions. The assembly further includes a pair of trousers, wherein the front strap portions are directly attached to a front portion of the trousers and the rear strap portions are directly attached to a rear portion of the trousers. At least one of the front strap portions or the rear strap portions is coupled to the trousers by hook-and-loop fastening material.

In another embodiment, the invention is a pair of suspenders that provide protection, in the form of padding, to a wearer's back. More particularly, in one embodiment the invention is a suspenders assembly including a pair of suspenders having a pair of front strap portions configured to be coupled to a pair of trousers and a pair of rear strap portions configured to be coupled to the pair of trousers. The suspenders further include a padded portion coupled to and extending between the rear strap portions. The padded portion is configured and location to lie on a wearer's back when the suspenders are worn over the shoulder of a wearer, the padded portion having a greater padding than the strap portions.

Other embodiments of the present invention will be apparent from the following description, the accompanying drawings and the claims.

DETAILED DESCRIPTION

Figure 1:
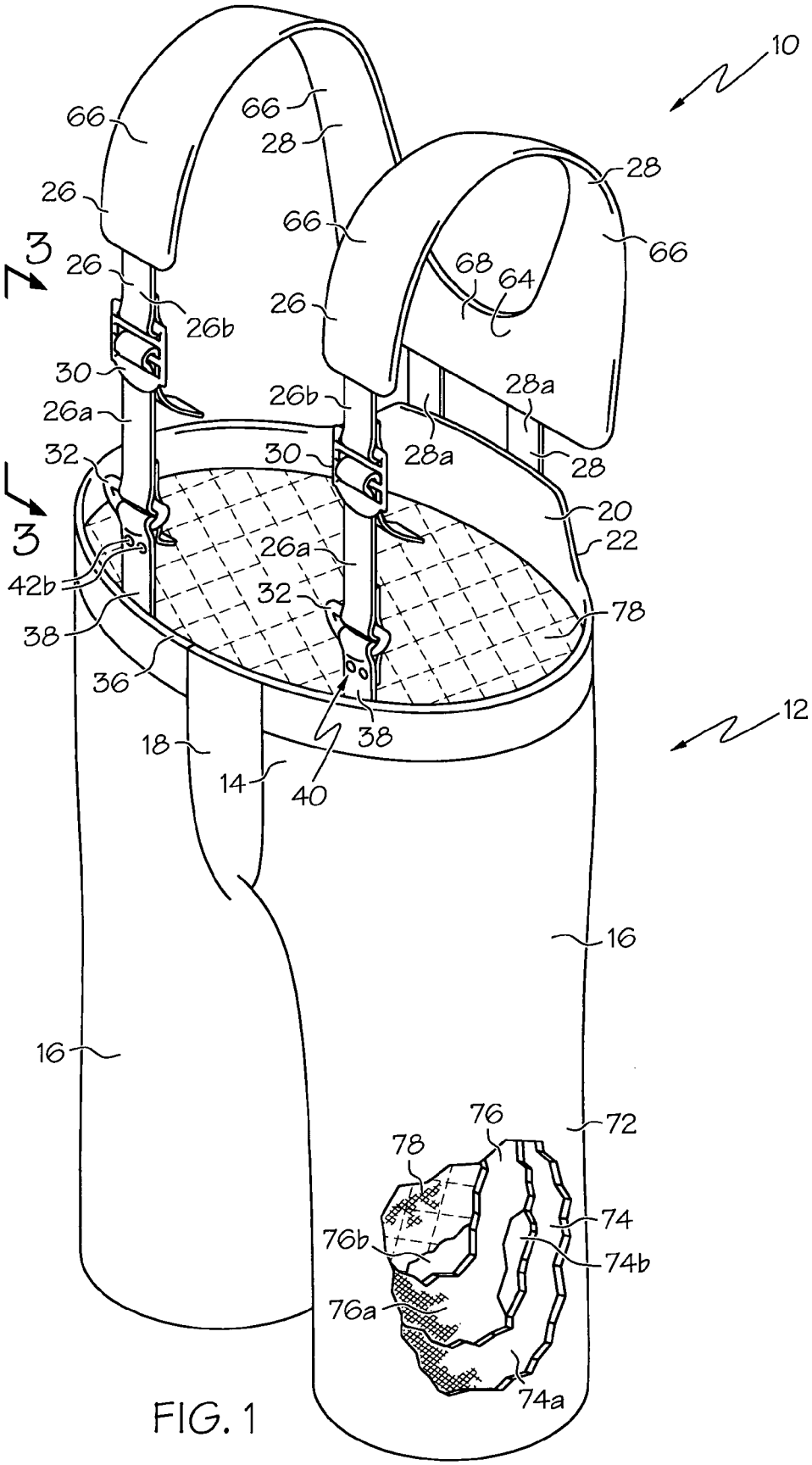
FIG. 1 is a front perspective view of one embodiment of the suspenders of the present invention, shown attached to a pair of trousers, with a portion of the trousers being cut away to illustrate the various layers thereof.

As shown in FIG. 1, one embodiment of the suspenders of the present invention, generally designated 10, are configured to be coupled to a pair of trousers 12. The trousers 12 may have a torso portion 14 configured to receive the lower torso of a wearer, and a pair of legs 16 extending downwardly from the torso portion 14. The trousers 12 may include a front portion 18 and a rear portion 20. The rear portion 20 may include a raised panel 22 to provide additional protection to the back of the wearer.

When worn, the suspenders 10 are configured to fit about the shoulders of a wearer 24 (see FIG. 5) to support and position the trousers 12 in the well known manner of suspenders. In the illustrated embodiment the suspenders 10 includes a pair of front straps or strap portions 26 (that extend from the top of the shoulders of a wearer to the top of trousers 12 along the front of a wearer), and a pair of rear straps or strap portions 28 (that extend from the top of the shoulders of a wearer to the top of the trousers 12 along the back of a wearer). As will be described in greater detail below, in the illustrated embodiment each front strap 26 may include or be formed of various portions, such as front strap portions 26*a*, 26*b*, portions 66 of a padded connector 64, and/or strips of material 38. Each rear strap 28 may include or be formed of a rear strap portion 28*a*, base 68 and/or portions 66 of the padded connector 64.

Both front straps 26 are configured to be directly coupled to the front portion 18 of the pair of trousers 12, and both rear straps 28 are configured to be directly coupled to the rear portion 22 of the trousers 12. Thus a distal end of each front strap 26 is spaced away from, and is not directly coupled to, a distal end of any of said rear straps 28.

Figure 3:
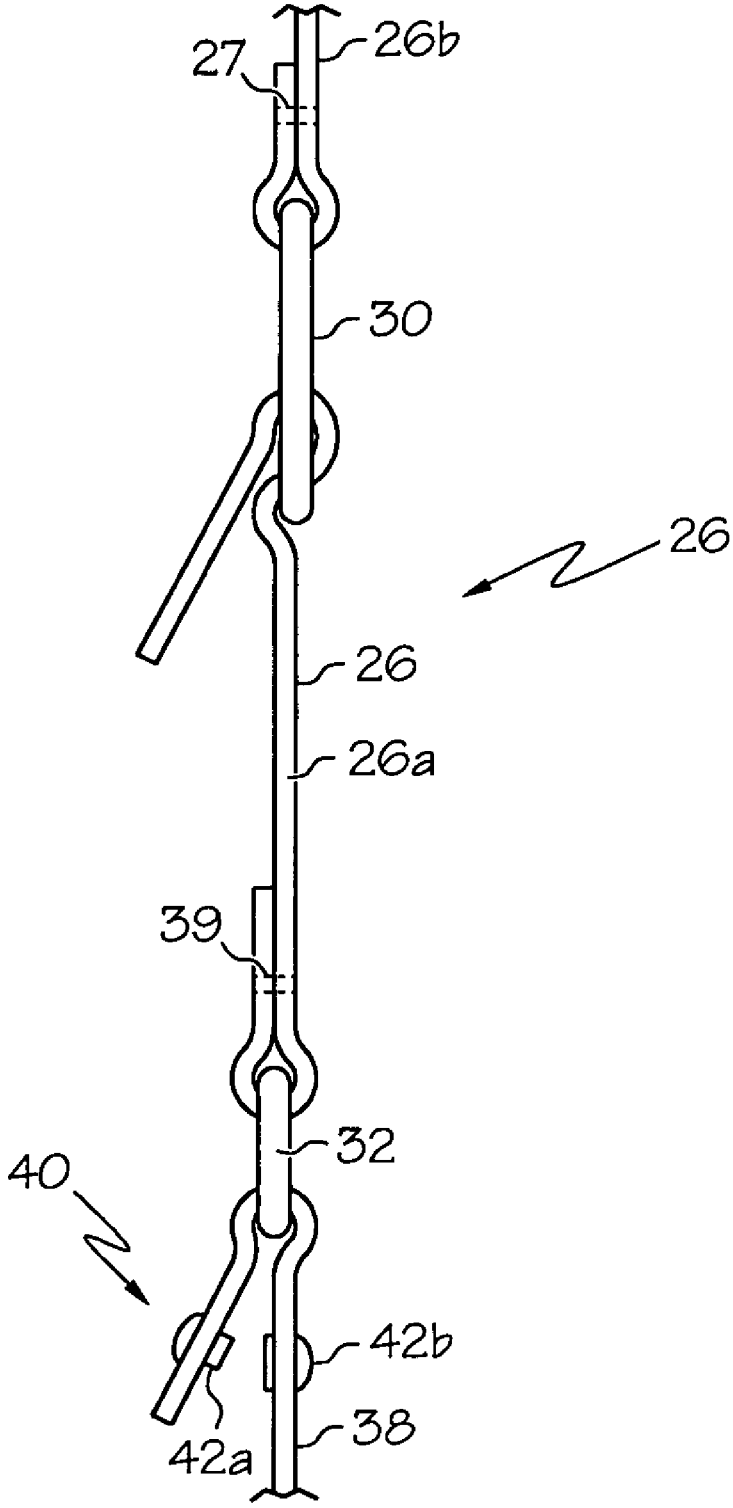
FIG. 3 is a side view of a connector of the suspenders and trousers of FIG. 1.

Each front strap 26 may be made of or include two front strap portions 26*a*, 26*b*, with the front strap portions 26*a*, 26*b* being joined by a buckle 30. The strap portion 26*b* is wrapped around the buckle 30 and coupled to itself by, for example, stitching 27 (see FIG. 3). Strap portion 26*a* is threaded through the buckle 30 such that the effective length of each front strap 26 can be adjusted by threading or unthreading the strap portion 26*a* through the buckle 30.

In the illustrated embodiment each front strap portion 26*a* has a connector 32 located at a lower or distal end thereof, with each connector 32 in the form of a generally D-shaped bracket in the illustrated embodiment. Each front strap portion 26*a* is wrapped around the straight portion of the associated connector 32 and coupled to itself by, for example, stitching 39 (see FIG. 3). Each connector 32 is configured to cooperate with a corresponding coupling component on the trousers 12 to mechanically couple each front strap 26 to the upper portion front portion 18 (for example, the upper edge, belt line 36 or adjacent thereto) of the trousers 12.

Each connector 32 is configured to mechanically engage the trousers 12. For example, in the illustrated embodiment a pair of strips of material 38 are coupled to the upper edge 36 of the trousers 12, such as by stitching. Each strip of material 38 includes a coupling component 40 in the form of two snap connectors 42 located thereon. Each snap connector 42 includes a first snap connector portion 42*a* (i.e. a male snap connector portion) and a second snap connector portion 42*b* (i.e. a female snap connector portion) located thereon. In order to couple each connector 32 (and therefore each front strap 26) to the trousers 12, each strip of material 38 is threaded through the corresponding connector 32. The snap portions 42*a*, 42*b* are then engaged to releasably secure each strip 38 to itself.

Of course, various other connectors could be located on the strips 38 to couple each strip to itself. If addition, the connectors 40 need not necessarily include the brackets 32 and/or strip 38 with snaps, and could take any of a wide variety of forms, including but not limited to hooks, brackets, clasps, clips, ties, buttons, snaps, zippers, slide fasteners, hook-and-loop fastening material (such as VELCRO®), interengaging geometries, and the like. As noted above, the strips 38 could be considered to form part of the front straps 26, rather than part of the trousers 12. However, because the strips 38 may be permanently coupled to the trousers, the strips 38 may more typically be considered as part of the trousers 12 and may be made of the same material as the trousers 12.

The rear straps 28 are configured to be coupled to the rear portion 20 of the trousers 12 and the upper portions thereof may be spaced away from each other at an angle to form a generally "V" shape when worn. Each rear strap 28 may be generally parallel and spaced apart from each other, and may be coupled, at their lower ends, to a generally flat, planar, attachment tab 46 (see FIGS. 2 and 4). Each rear strap 28 may be permanently and directly coupled to the attachment tab 46, such as by stitching, adhesives or the like. The attachment tab 46 has a pair of opposed surfaces 48, 50 and may be made of or include a hook-and-loop fastening material (such as VELCRO®), and/or may have hook-and-loop fastening material on both surfaces 48, 50 thereof. Both surfaces 48, 50 of the attachment tab 46 may be made of or include loop material, or both surfaces 48, 50 may be made of or include hook material, or, if desired, one surface 48, 50 may be made of loop material and the other surface 48, 50 may be made of hook material. The entirety of each surface 48, 50, or at least the majority of each surface 48, 50, may be made of or covered by hook-and-loop fastening material to provide increased coupling ability.

The attachment tab 46 may have a variety of sizes and shapes. For example, in the illustrated embodiment the attachment tab 46 is generally rectangular with a width (i.e. in a direction extending generally horizontally across the body of a wearer 24) of at least about two inches, or at least about four inches, or at least about six inches. The attachment tab 46 may have a height (i.e. generally perpendicular to the width) of at least about one inch, or at least about three inches, or at least about four inches. The attachment tab 46 may have a surface area of at least about 10 square inches, or 20 square inches, or 30 square inches, or other surface areas as can be calculated using the dimensions above.

The rear portion 20 of the trousers 12 may have a coupling portion 54 including a pair of patches 56, 58 of hook-and-loop fastening material. Both patches 56, 58 may have about the same size and shape, and may be permanently coupled to the trousers 12, such as by stitching, adhesives or the like. Both patches 56, 58 may have about the same size and shape as the attachment tab 46, but may be slightly larger than the attachment tab 46 to provide flexibility in the locations in which the attachment tab 46 can be received. The lower edge of patch 58 may be pivotally coupled to the trousers 12 such that patch 58 is movable or pivotable about hinge line 60.

Figure 2:
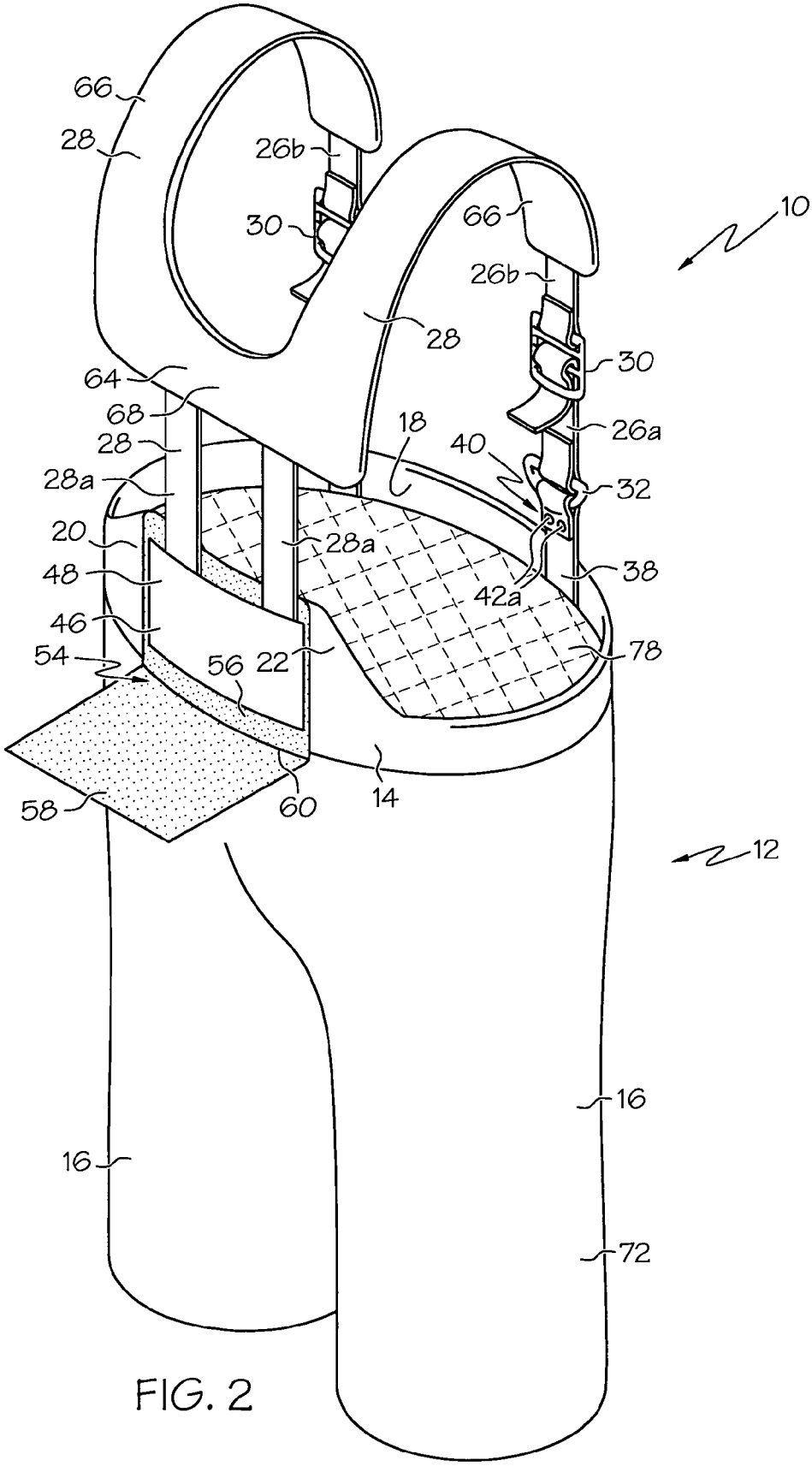
FIG. 2 is a rear perspective view of the suspenders and trousers of FIG. 1.
Figure 4:
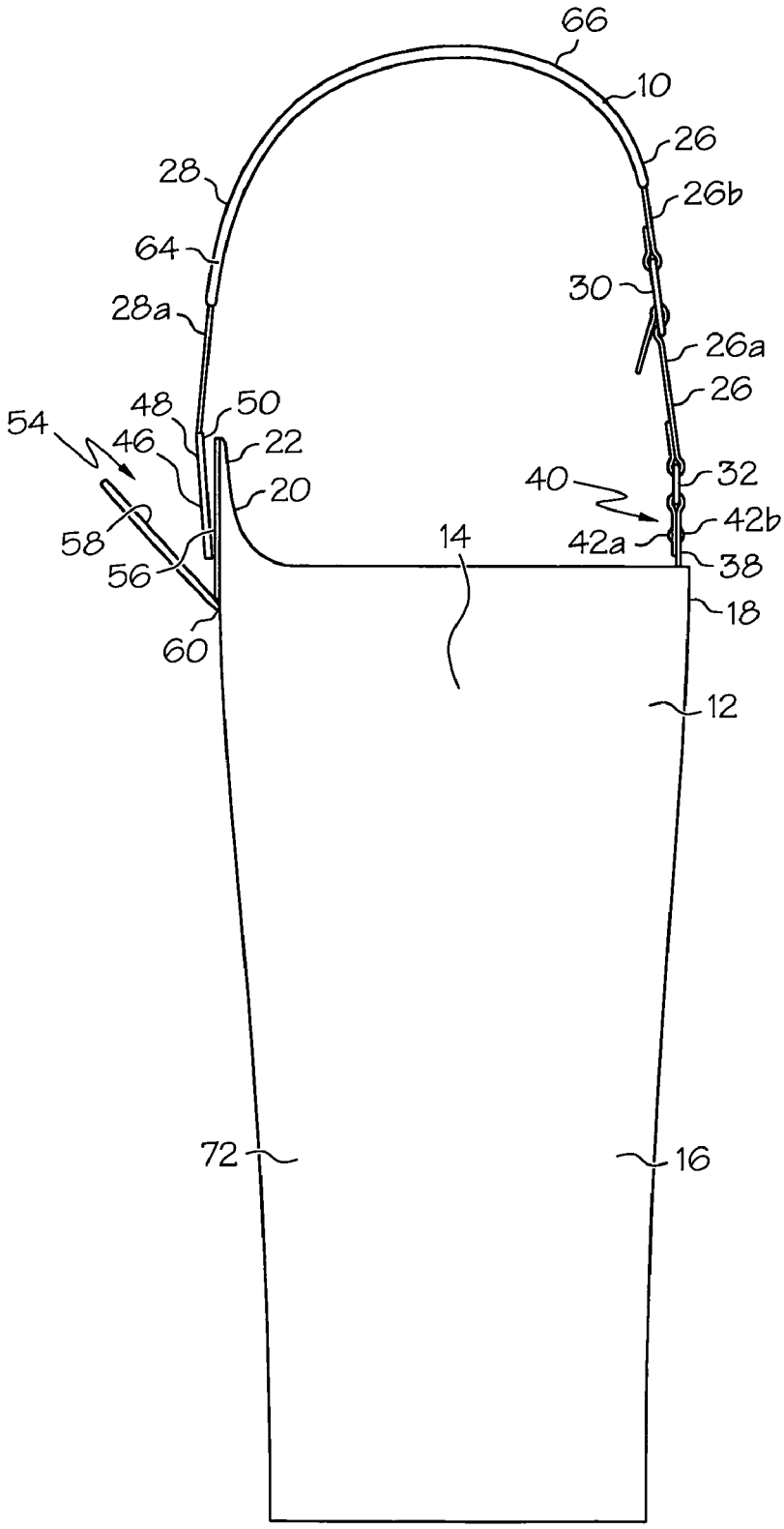
FIG. 4 is a side view of the suspenders and trousers of FIG. 1, with the attachment flap pivoted open.

In order to couple the suspenders 10 to the coupling portion 54, the patches 56, 58 of hook-and-loop fastening material of the coupling portion 54 are first separated, as shown in FIGS. 2 and 4 (i.e. by pivoting the patch 58 about its fold line 60). Next, the attachment tab 46 of the suspenders 10 is positioned between the patches 56, 58. Patch 58 is then pivoted about its hinge line 60 to bring the patch 58 into contact with the tab 46 and press the tab 46 into contact with patch 56. All of the portions of hook-and-loop fastening material 48, 50, 56, 58 are thereby pressed into contact to ensure that the attachment tab 46 is securely gripped in the coupling portion 54. Because the attachment tab 46 is coupled on both sides 48, 50, and has a relatively large surface area, a strong and secure attachment is provided.

The strong and secure attachment may allow a user to position the attachment tab 46 in various positions; i.e. in positions in which a portion of the attachment tab 46 protrudes upwardly from the coupling portion 54. In other words, the attachment tab 46 may be able to be positioned at various vertical positions to provide a crude height adjusting feature to the suspenders 10. In addition, because both rear straps 28 are coupled to the tab 46, both rear straps 28 can be quickly and easily simultaneously coupled to, and uncoupled from the trousers 12 with a single step. This can be important as time can be of the essence in fire rescue and hazardous material situations, in both donning and doffing the trousers 12.

In one embodiment, the portions of hook-and-loop fastening material 48, 50, 56, 58 may be configured such that the attachment tab 46 can be properly secured in the coupling portion 54 in only a single orientation (i.e. when facing the proper direction) to ensure proper mounting of the suspenders 10. In another embodiment the portions of hook-and-loop fastening material 48, 50, 56, 58 may be configured such that the attachment tab 46 can be properly secured in the coupling portion 54 in any orientation (i.e. when facing either direction) to provide flexibility and ease of use.

Figure 6:
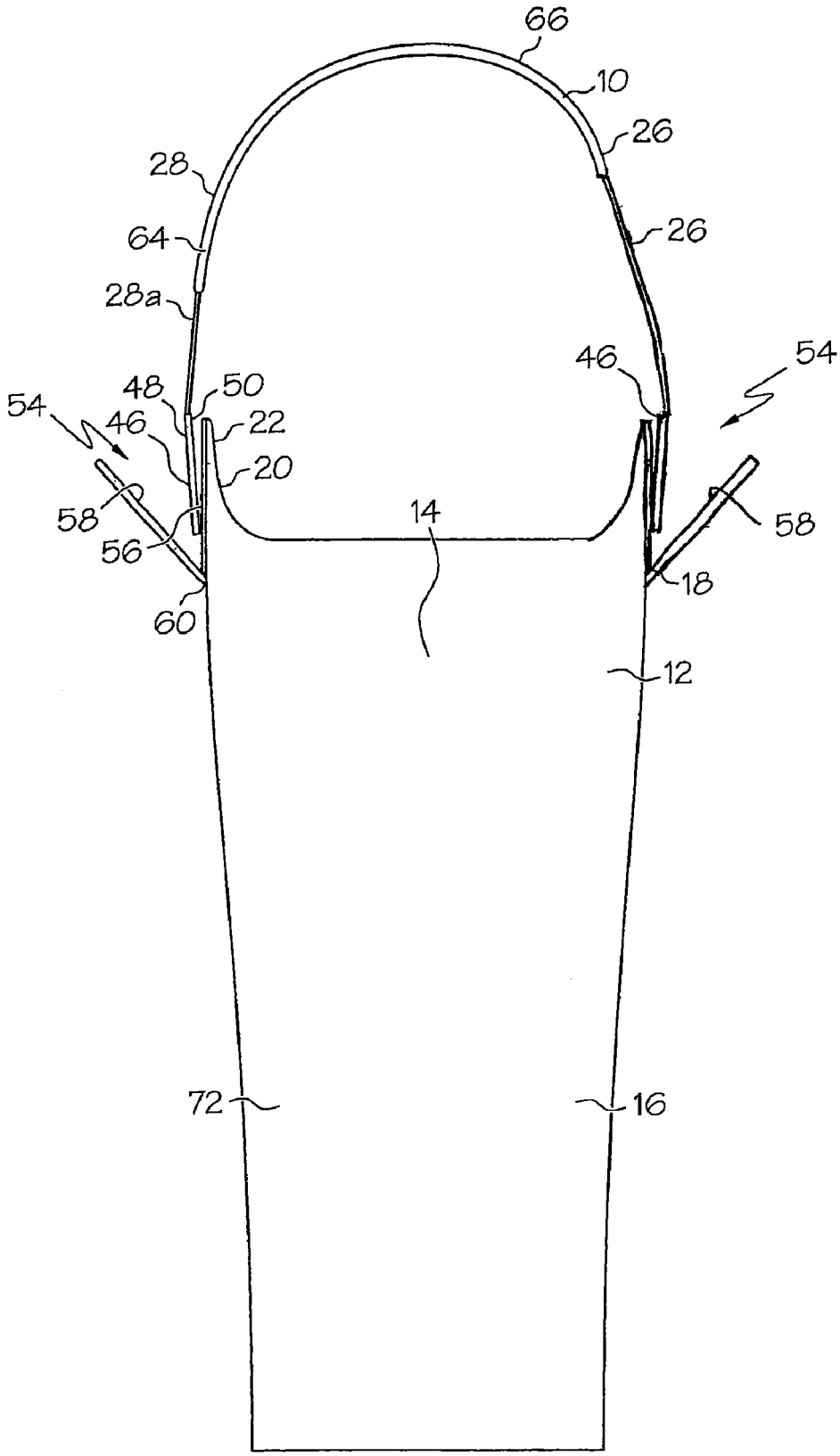
FIG. 6 is a side view of an alternate embodiment of suspenders and trousers with a front and a back attachment flap pivoted open.

If desired, as illustrated in FIG. 6, the coupling portion 54/tab 46 may also or instead be used to attach the front straps 26 to the front of the trousers 12, in which case the coupling portion 54/tab 46 could replace the connectors 32. In addition, if desired, patch 58 of the hook-and-loop fastening material may not be utilized, in which case only the patch 56 may attach the suspenders 10 to the trousers 12. Alternately, patch 56 may be omitted and patch 58 may be used alone.

The suspenders 10 may include a generally horizontally-extending padded connector portion 64 located between and/or forming part of the rear straps 28 or front straps 26. The padded connector portion 64 may be generally "U" shaped in front view having a pair of legs 66 and a base portion 68 extending between the legs 66. Each leg 66 may be or form part or a portion of the front and/or rear straps 26, 28. The base portion 68 may be directly coupled to the upper ends of each rear strap portion 28*a*, such as by stitching, adhesives or the like. Alternately, the upper ends of each rear strap portion 28*a* may be received inside the connector portion 64. Similarly, the upper end of each front strap portion 26*b* may be directly coupled to an associated ones of the legs 66, such as by stitching, adhesives or the like, or the front strap portion 26*b* may be received inside the associated leg 66.

If desired, each front strap portion 26*b* and an associated rear strap portion 28*a* may be formed of a single strap or single continuous piece of material that passes through the connector portion 64. In this case, that single piece of material could be freely slidable within the connector portion 64, or could be coupled to the connector portion 64 such that the single piece of material is not slidable relative to the connector portion 64. Of course, if desired, each strap portion 28*a*, 26*b* can be a separate piece of material that is coupled to the connector portion 64, such as by stitching, adhesives or the like.

The strap portions 26*a*, 26*b*, 28*a* may be made from a relatively thin, strap-like fabric material. In one embodiment, the strap portions 26*a*, 26*b*, 28*a* may be made from an elastic material, such as non-elastic fibers interwoven with elastic fibers. Alternately, the strap portions 26*a*, 26*b*, 28*a* are made from a generally non-elastic material, such as nylon. If desired the strap portions 26*a*, 26*b*, 28*a* and connector portion 64 may be made from a durable and fire-resistant material.

The connector portion 64 may be made from a fabric material and may include a padding material attached thereto or contained therein. The connector portion 64 may be, for example a woven fire-resistant fabric material with an inner cavity. A padding material may be located therein, which can be or include, without limitation, foam such as closed cell foam, open cell foam, silicon foam, BASOTECT™ foam (a trademark of BASF Aktiengesellshaft), elastic or polymeric material, air pockets, rubber, aramid materials, or other like material capable of absorbing and/or cushioning an impact. The connector portion 64 may have more padding as compared to the strap portions 26*a*, 26*b*, 28*a*. In addition, the connector portion 64 may have a thickness, in its uncompressed state, of at least about 1/16 inch, or at least about 1/8 inch. The connector portion 64 may have a surface area of at least about 0.01 square feet, or at least about four square inches, or at least about nine square inches, or at least about sixteen square inches, or at least about twenty-five square inches, or at least about thirty-six square inches, to provide sufficient cushioning (i.e., from a tank 70).

Figure 5:
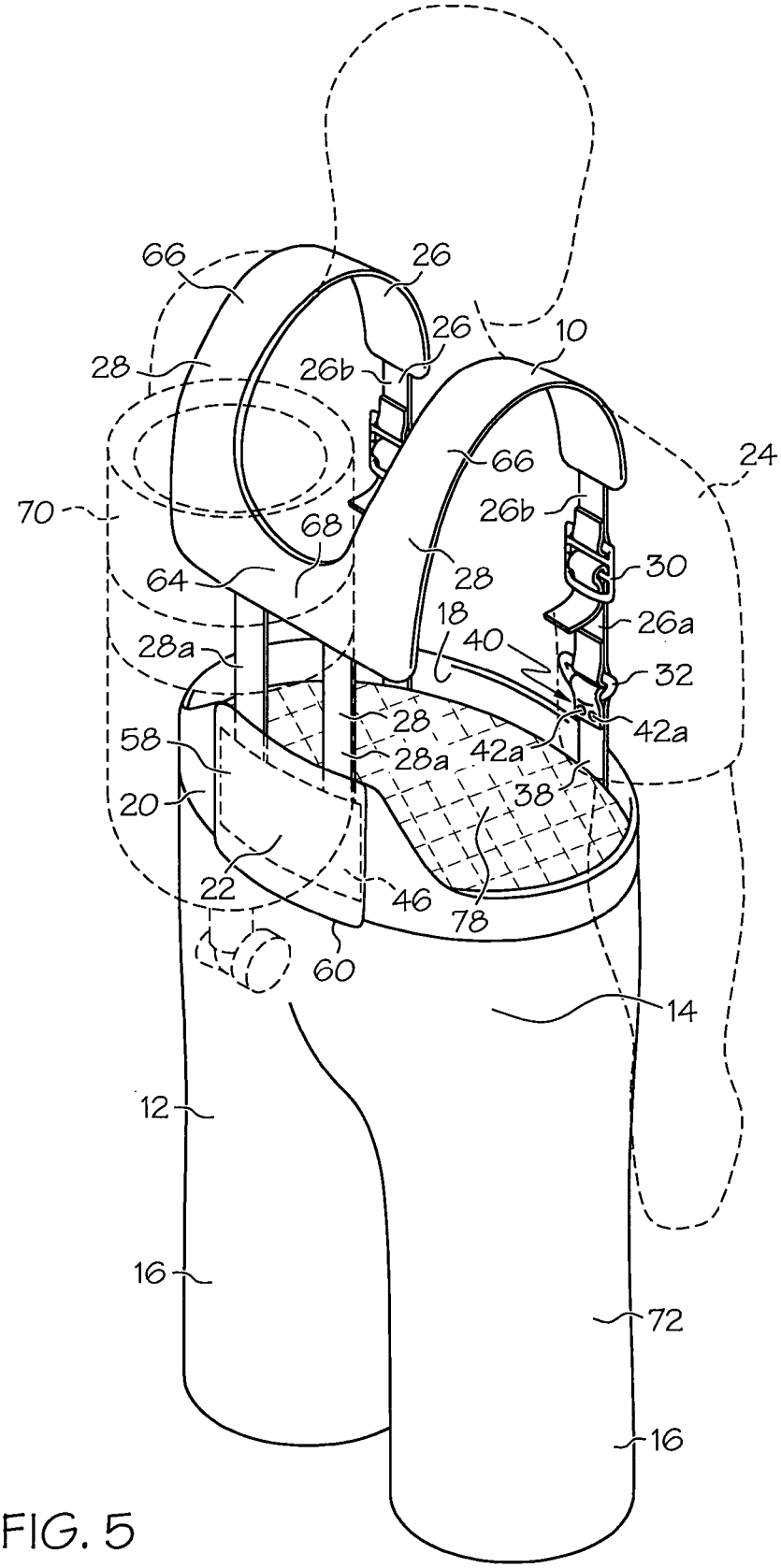
FIG. 5 is a rear perspective view of the trousers of FIG. 1, with a wearer and a gas canister shown in hidden lines.

The base portion 68 secures the rear straps 28 together to ensure that they remain aligned and properly positions. In addition, base portion 68/connector portion 64 may be shaped and sized to align with the center of a wearer's back. In particular, the padded connector portion 64 may have a surface area (as outlined above) sufficient to cover and protect a significant portion of a wearer's back. When used in firefighting and other hazardous conditions, a wearer may wear or carry a compressed gas tank, a SCBA tank 70 or the like, as shown in FIG. 5. Such tanks 70 are typically carried on the wearer's back in a back-pack style carrying arrangement. Thus, the connector portion 64 provides additional padding or other shock-absorbent material to absorb the impact of a tank 70 worn on the wearer's back. The padding provided by the connector portion 74 can be of particular importance since movement of the wearer, including walking, running, kneeling, standing, etc. can cause the tank 70 to "bounce" on the wearer's back. Thus the connector portion 64 provides padding, protection and comfort to the wearer.

The trousers 12 may be constructed from a durable and fire-resistant material, as will now be described to greater detail. However, the suspenders 10 of the present invention may be used with various types of garments, and are not necessarily limited to use with such protective garments. In one embodiment, the trousers 12 may include various layers through its thickness to provide various heat, moisture and abrasion resistant qualities to the trousers 12 so that the trousers 12 may be used as a protective, hazardous duty, or firefighter garment. For example, as shown in FIG. 1, the trousers 12 may include an outer shell 72, a moisture barrier 74 located inside of and adjacent to the outer shell 72, a thermal liner or barrier 76 located inside of and adjacent to the moisture barrier 74, and an inner liner or face cloth 78 located inside of and adjacent to the thermal liner 76.

The outer shell 72 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of Celanese Corp. of Charlotte, N.C.). Thus, the outer shell 72 may be an aramid material, a blend of aramid materials, a polybenzamidazole material, a blend of aramid and polybenzamidazole materials, or other appropriate materials. The materials of the outer shell 72 may have a weight of, for example, between about six and about ten oz/yd$^2$. The strap portions 26*a*, and/or strap 38, 26*b*, 28*a* and/or outer layers of the connector portion 64 can be made of the same materials as the outer shell 72.

The moisture barrier 74 and thermal liner 76 may be generally coextensive with the outer shell 72, or spaced slightly inwardly from the outer edges of the outer shell 72 to provide moisture and thermal protection throughout the trousers 12. The moisture barrier 74 may include a semi-permeable membrane layer 74*a* and a substrate 74*b*. The membrane layer 74*a* may be generally moisture vapor permeable but generally impermeable to liquid moisture.

The membrane layer 74*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, or other materials. The membrane layer 74*a* may have microscopic openings that permit moisture vapor (such as water vapor) to pass therethrough, but block liquids (such as water) from passing therethrough. The membrane layer 74*a* may be made of a microporous material that is either hydrophilic, hydrophobic, or somewhere in between. The membrane layer 74*a* may also be monolithic and may allow moisture vapor transmission therethrough by molecular diffusion. The membrane layer 74*a* may also be a combination of microporous and monolithic materials (known as a bicomponent moisture barrier), in which the microporous or monolithic materials are layered or intertwined.

In the illustrated embodiment, the membrane layer 74*a* is bonded or adhered to a substrate 74*b* of a flame and heat resistant material to provide structure and protection to the membrane layer 74. The substrate 74*b* may be or include aramid fibers similar to the aramid fibers of the outer shell 72, but may be thinner and lighter in weight. The substrate 74*b* may be woven, non-woven, spunlace or other materials. In the illustrated embodiment, the membrane layer 74*a* faces the outer shell 72. However, the orientation of the moisture barrier 74 may be reversed such that the substrate 74*b* faces the outer shell 72.

The thermal liner 76 may be made of any suitable material that provides sufficient thermal insulation. In one embodiment, the thermal liner 76 may include a relatively thick (i.e. between about 1/16"-3/16") batting, felt or needled non-woven material 76*a* which can include aramid fiber batting (such as NOMEX batting), aramid needlepunch material, an aramid non-woven material, an aramid blend needlepunch material, an aramid blend batting material, an aramid blend non-woven material, or foam (either open cell or closed cell) materials. The batting 76*a* may be configured to trap air and possess sufficient loft to provide thermal resistance to the trousers 12.

The batting 76*a* is typically quilted to the face cloth 76*b*, which can be a weave of a lightweight aramid material. Thus, either the batting 76*a* alone, or the batting 76*a* in combination with the face cloth 76*b*, may be considered to be the thermal liner 76. In one embodiment, the thermal liner 76 may have a thermal protection performance ("TPP") of at least about twenty, or of at least about thirty-five. If desired, the thermal liner 76 may be treated with a water-resistant material.

Although the moisture barrier 74 is shown as being located between the outer shell 72 and the thermal liner 76, the positions of the moisture barrier 74 and thermal liner 76 may be reversed such that the thermal liner 76 is located between the outer shell 72 and the moisture barrier 74. The face cloth 78 may be the innermost layer of the trouser 12, and can provide a comfortable surface for the wearer and protect the thermal liner 76 and/or moisture barrier 74 from abrasion and wear.

Each layer of the trousers 12, and the trousers 12 as a whole, as well as the suspenders 10, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the outer shell 72, moisture barrier 74 and thermal liner 76 of the trousers 12 must be able to resist igniting, burning, melting, dripping and/or separation at a temperature of 500° F. for at least five minutes. Furthermore, in order to meet the NFPA standards, all combined layers of the trousers 12 must provide a thermal protective performance rating of at least thirty-five.

Although the invention is shown and described with respect to certain embodiments, it is obvious that modifications will occur to those skilled in the art upon reading and understanding the specification, and the present invention includes all such modifications.

What is claimed is:

1. A suspenders assembly comprising a pair of suspenders including:

a pair of straps comprising a first strap and a second strap, the first strap having a front first strap portion configured to be coupled to a front portion of a pair of trousers and a rear first strap portion, and the second strap having a front second strap portion configured to be coupled to the front portion of the pair of trousers and a rear second strap portion;

a connector portion interconnecting the first strap to the second strap; and a one-piece attachment tab having a means for detachably attaching to a rear portion of the pair of trousers, wherein the rear first strap portion and the rear second strap portion both terminate at the one-piece attachment tab, the one-piece attachment tab interconnecting the rear first strap portion to the rear second strap portion such that the rear first strap portion and the rear second strap portion are simultaneously attachable to the pair of trousers through the one-piece attachment tab.

2. The assembly of claim 1 wherein the rear first strap portion and the rear second strap portion are directly and permanently coupled to said one-piece attachment tab, and wherein the front first strap portion and the front second strap portion are configured to be individually attached to said front portion of said trousers.

3. The assembly of claim 1 wherein said one-piece attachment tab is generally flat and planar and has a pair of opposed faces, wherein a portion of at least one of the opposed faces includes hook-and-loop fastening material covering substantially the entirety thereof.

4. The assembly of claim 3 wherein the opposed faces both include hook-and-loop fastening material covering substantially the entirety thereof.

5. The assembly of claim 1 wherein the first strap and the second strap are both generally made of a fire resistant material.

6. The assembly of claim 1 wherein the connector portion includes a padding material and is configured and located to lie on a wearer's back when said suspenders are worn.

7. The assembly of claim 1 wherein said one-piece attachment tab has a surface area of at least about 20 inches.

8. The assembly of claim 1 wherein a distal end of the front first strap portion is configured to be spaced away from, and not directly coupled to, a distal end of the rear first strap portion when said suspenders are worn.

9. The assembly of claim 1 further comprising said pair of trousers, and wherein said pair of suspenders are coupled to said trousers.

10. The assembly of claim 3 further comprising said pair of trousers, wherein said trousers include a mating portion of hook-and-loop fastening material located and configured to detachably attach with the hook-and-loop fastening material of said one-piece attachment tab, wherein the one piece attachment tab is detachably attached to said trousers.

11. A suspenders assembly comprising a pair of suspenders including:

a pair of front strap portions configured to be coupled to a front portion of a pair of trousers;

a pair of rear strap portions configured to be coupled to a rear portion of said pair of trousers; and a one-piece attachment tab, wherein said pair of rear strap portions or said pair of front strap portions are directly and permanently coupled to said attachment tab, wherein said attachment tab includes a portion or hook-and-loop fastening material located thereon;

a pair of trousers, said pair of suspenders being coupled to said trousers, wherein said trousers include a portion of hook-and-loop fastening material located and configured to interact with said portion of hook-and-loop fastening material of said attachment tab to attach said suspenders to said trousers;

wherein said portion of hook-and-loop fastening material of said trousers is located adjacent to a rear upper edge of said trousers.

12. The assembly of claim 10 wherein the mating portion of hook-and-loop fastening material of said trousers and the hook-and-loop fastening material of the one-piece attachment tab have generally the same size and shape.

13. The assembly of claim 10 wherein said trousers further include another portion of hook-and-loop fastening material, wherein said portions of hook-and-loop fastening material of said trousers are located and configured to receive said one-piece attachment tab therebetween.

14. A suspenders assembly comprising a pair of suspenders including:

a pair of front strap portions configured to be coupled to a front portion of a pair of trousers;

a pair of rear strap portions configured to be coupled to a rear portion of said pair of trousers; and a one-piece attachment tab, wherein said pair of rear strap portions or said pair of front strap portions are directly and permanently coupled to said attachment tab, wherein said attachment tab includes a portion of hook-and-loop fastening material located thereon;

a pair of trousers, said pair of suspenders being couplable to said trousers, wherein said trousers include a portion of hook-and-loop fastening material located and configured to interact with said portion of hook-and-loop fastening material of said attachment tab to attach said suspenders to said trousers; wherein said trousers further include another portion of hook-and-loop fastening material, wherein said portions of hook-and-loop fastening material of said trousers are located and configured to receive said attachment tab therebetween;

wherein one of said portions of hook-and-loop fastening material of said trousers is pivotally coupled to said trousers, and the other portion of said hook-and-loop fastening material is fixedly and non-movably coupled to said trousers.

15. The assembly of claim 9 wherein the front first strap portion and the front second strap portion are directly attached to said front portion of said trousers, and said one-piece attachment tab is directly attached to said rear portion of said trousers.

16. The assembly of claim 15 wherein the front first strap portion and the second front strap portion are directly mechanically coupled to said trousers, and are not directly coupled to said trousers by hook-and-loop fastening material.

17. The assembly of claim 9 wherein said trousers meet National Fire Protection Association 1971 standards for protective firefighting garments.

18. The assembly of claim 9 wherein said trousers include an outer shell.

19. The assembly of claim 18 wherein said outer shell is abrasion, flame and heat resistant.

20. The assembly of claim 18 wherein said outer shell resists igniting, burning, melting, dripping or separation when exposed to a temperature of 500° F. for at least five minutes.

21. The assembly of claim 18 wherein said outer shell includes a material selected from a group of consisting of an aramid material, a blend of aramid materials, a polybenzamidazole material, and a blend of aramid and polybenzamidazole materials.

22. The assembly of claim 18 further comprising a moisture barrier located generally inside of said outer shell such that when said trousers are worn said moisture barrier is located generally between said outer shell and a wearer of said trousers, said moisture barrier being made of a material that is generally liquid impermeable and generally moisture vapor permeable.

23. The assembly of claim 18 further comprising a thermal liner located generally inside said outer shell such that when said trousers are worn said thermal liner is located generally between said outer shell and a wearer of said trousers, wherein said thermal liner has a thermal protection performance of at least about 20.

24. A suspenders assembly comprising a pair of suspenders including:

a pair of front strap portions configured to be coupled to a pair of trousers;

a pair of rear strap portions configured to be coupled to said pair of trousers;

a one-piece attachment tab, wherein said pair of rear strap portions or said pair of front strap portions terminate at said one-piece attachment tab, said one-piece attachment tab being configured to be coupled to said pair of trousers to couple said rear or front strap portions to said pair of trousers; and padded portion coupled to and extending between said rear strap portions, wherein said padded portion is configured and location to lie on a wearer's back when said suspenders are worn over the shoulder of a wearer, said padded portion having a greater padding than said strap portions in a thickness direction thereof.

25. The suspenders of claim 24 wherein said padded portion is a woven fire resistant material with an inner cavity.

26. The assembly of claim 25 wherein said padded portion includes a padding material located in said inner cavity.

27. The assembly of claim 24 wherein said padded portion has a thickness of at least about 1/16 inch.

28. The assembly of claim 24 wherein said padded portion has a surface area of at least about twenty five square inches.

29. The assembly of claim 24 wherein at least one of said strap portions includes a portion of hook-and-loop fastening material located thereon or directly coupled thereto to couple said at least one strap portion to a pair of trousers.

30. The assembly of claim 24 further comprising a pair of trousers, wherein said pair of suspenders are directly coupled to said trousers, and wherein said trousers meet National Fire Protection Association 1971 standards for protective firefighting garments.

31. The assembly of claim 24 wherein said suspenders include an attachment tab, wherein said rear strap portions are both directly and permanently coupled to said attachment tab, wherein said attachment tab includes a portion of hook-and-loop fastening material located thereon.

32. The assembly of claim 24 wherein said rear strap portions and said front strap portions are both configured to be located on or immediately adjacent to the shoulders of a wearer.

33. The assembly of claim 24 wherein said front and rear strap portions are fire resistant.

34. The assembly of claim 6 wherein the connector portion is of a generally U-shaped padded connector portion.

35. The assembly of claim 34 wherein the generally U-shaped padded connector portion has more padding than the rear first strap portion and the rear second strap portion.

36. The assembly of claim 34 wherein the generally U-shaped padded connector portion has more padding than the front first strap portion and the front second strap portion.

37. The assembly of claim 34 wherein the first strap is a single piece of continuous material that passes through the generally U-shaped padded connector portion.

38. The assembly of claim 37 wherein the second strap is a single piece of continuous material that passes through the generally U-shaped padded connector portion.

39. The assembly of claim 38 wherein the generally U-shaped padded connector portion includes a first leg and a second leg extending from the connector portion, the first leg and second leg being configured and located to lie on different shoulders of the wearer.

* * * * *

UNITED STATES PATENT AND TRADEMARK OFFICE

CERTIFICATE OF CORRECTION

PATENT NO. : 8,104,100 B2
APPLICATION NO. : 11/333851
DATED : January 31, 2012
INVENTOR(S) : Ali Razzaghi et al.

It is certified that error appears in the above-identified patent and that said Letters Patent is hereby corrected as shown below:

Column 8

Claim 11, line 55, reads “or” should read -- of --

Claim 11, line 57, reads “coupled” should read -- couplable --

Column 9

Claim 20, line 50, reads “F.” should read -- F --

Column 10

Claim 24, Line 15, reads “padded” should be -- a padded --

Claim 34, line 51, reads “is of a” should read -- is part of a --

Signed and Sealed this
Nineteenth Day of June, 2012

David J. Kappos

David J. Kappos
*Director of the United States Patent and Trademark Office*